US008061293B2

(12) United States Patent
Auerbach et al.

(10) Patent No.: US 8,061,293 B2
(45) Date of Patent: Nov. 22, 2011

(54) AVALANCHE RESCUE DEVICE

(76) Inventors: Paul Stuart Auerbach, Los Altos, CA (US); Joshua Bryan Carter, Bakersfield, CA (US); Lauren Renee Fuller, Los Alamitos, CA (US); Daniel Robert Haylett, Mountain View, CA (US); Aaron Kombai Knoll, Guildford (GB); John Pierce Reitenberg, Northbrook, IL (US); Andrew Wayne Smith, Mountain View, CA (US); Eric Jarl Thorsell, San Francisco, CA (US)

( * ) Notice: Subject to any disclaimer, the term of this patent is extended or adjusted under 35 U.S.C. 154(b) by 14 days.

(21) Appl. No.: 12/660,425

(22) Filed: Feb. 26, 2010

(65) Prior Publication Data

US 2010/0243756 A1 Sep. 30, 2010

Related U.S. Application Data

(60) Provisional application No. 61/208,659, filed on Feb. 27, 2009.

(51) Int. Cl.
*A63B 29/02* (2006.01)

(52) U.S. Cl. ..... 116/209; 116/210; 116/DIG. 44; 128/202.19

(58) Field of Classification Search ..... 116/209–210, 116/DIG. 8, DIG. 9, DIG. 44, 211; 455/404.1; 128/204.18, 202.19; 239/289; 222/175, 222/478, 486, 399, 4, 608, 325, 504, 146.5, 222/146.1, 146.2, 145.1, 638–641
See application file for complete search history.

(56) References Cited

U.S. PATENT DOCUMENTS

| | | | | |
|---|---|---|---|---|
| 4,114,561 | A * | 9/1978 | Asaro | 116/210 |
| 4,365,628 | A * | 12/1982 | Hodel | 128/205.12 |
| 4,635,754 | A * | 1/1987 | Aschauer et al. | 182/3 |
| 4,688,643 | A * | 8/1987 | Carter et al. | 169/33 |
| 4,807,813 | A * | 2/1989 | Coleman | 239/153 |
| 4,932,133 | A * | 6/1990 | Bruhn | 33/377 |
| 5,007,368 | A * | 4/1991 | Bush | 116/211 |
| 5,400,934 | A * | 3/1995 | Ducros | 224/148.2 |
| 5,490,501 | A * | 2/1996 | Crowley | 128/204.17 |
| 5,784,724 | A * | 7/1998 | Liang | 2/424 |
| 5,911,406 | A * | 6/1999 | Winefordner et al. | 251/339 |
| 6,000,395 | A * | 12/1999 | Brown | 128/202.19 |
| 6,120,337 | A * | 9/2000 | Real et al. | 441/88 |
| 6,167,249 | A * | 12/2000 | Hereford et al. | 455/404.2 |
| 6,220,909 | B1 * | 4/2001 | Aschauer et al. | 441/80 |

(Continued)

OTHER PUBLICATIONS

Derwent Abstract 2008-H15567, Inventor—Yang, Abstract of CN 101190363 A, published Jun. 4, 2008, title "Avalanche self-saving device, has steam injecting device connected with steam generator device and steam connecting pipe whose end is connected with steam pipe connecting port of steam generator device".*

(Continued)

*Primary Examiner* — R. A. Smith
*Assistant Examiner* — Tania Courson

(57) ABSTRACT

A rescue device includes a control module to sense an avalanche, sense the direction of the surface and establish a target path to the surface. A nozzle is selected or oriented by the control module along the target path. A fluid reservoir is connected to the nozzle to force a fluid through the nozzle along the target path to the surface. This allows rescuers to identify the location of a victim and also provides an air path to the victim.

17 Claims, 4 Drawing Sheets

U.S. PATENT DOCUMENTS

| | | | | |
|---|---|---|---|---|
| 6,246,863 | B1 * | 6/2001 | Kampel | 455/100 |
| 6,270,386 | B1 * | 8/2001 | Visocekas | 441/80 |
| 6,412,482 | B1 * | 7/2002 | Rowe | 128/204.18 |
| 6,546,638 | B2 * | 4/2003 | Beyer | 33/348 |
| 6,889,690 | B2 * | 5/2005 | Crowder et al. | 128/203.15 |
| 7,261,608 | B2 * | 8/2007 | Haddacks | 441/80 |
| 7,270,077 | B2 * | 9/2007 | Beck | 116/210 |
| 7,346,336 | B2 * | 3/2008 | Kampel et al. | 455/404.2 |
| 7,574,973 | B2 * | 8/2009 | Markham | 116/209 |
| 7,603,961 | B2 * | 10/2009 | Mayenschein et al. | 116/215 |
| 7,654,260 | B2 * | 2/2010 | Ogilvie | 128/201.22 |
| 7,878,141 | B2 * | 2/2011 | Paynton et al. | 116/210 |
| 2004/0120774 | A1 * | 6/2004 | Courtney et al. | 405/185 |
| 2004/0244100 | A1 * | 12/2004 | Haddacks | 2/463 |
| 2006/0035622 | A1 * | 2/2006 | Kampel et al. | 455/404.2 |
| 2009/0239428 | A1 * | 9/2009 | Berchten | 441/80 |

OTHER PUBLICATIONS

Derwent Abstract 2001-490172, Patent Assignee—Weisselberg H, Abstract of DE 20006624 U1, published Aug. 16, 2001, title "Protective clothing for an avalanche has an inflatable vest and an inflatable hood over the head with a larger volume using a gas container for inflation tripped by a vibration sensor and/or a ripcord".*

Derwent Abstract 2005-254818, Patent Assignee—Skambraks, Abstract of DE 202004012164 U1, published Mar. 24, 2005, title "Safety helmet, for winter sports, incorporates signal transmitters and marker fluid released to locate and rescue a wearer buried by an avalanche ".*

Derwent Abstract 2005-234913, Patent Assignee—Skambraks, Abstract of DE 202004013711 U1, published Mar. 17, 2005, title "Avalanche search and rescue machine, includes vessel filled with liquid for marking and melting area of snow already searched".*

* cited by examiner

AVALANCHE RESCUE DEVICE

CROSS-REFERENCE TO RELATED APPLICATION

This application claims priority to the U.S. Provisional Patent Application entitled "Avalanche Rescue Device", Ser. No. 61/208,659, filed Feb. 27, 2009, the contents of which are incorporated herein.

FIELD OF THE INVENTION

This invention relates generally to safety devices. More particularly, this invention relates to a safety device for use in the event of an individual being trapped by an avalanche.

BACKGROUND OF THE INVENTION

There are approximately 100,000 avalanches each year in the U.S. alone, resulting in at least 200 people being trapped, of which approximately half are killed or injured. Death is most commonly from asphyxiation, with survival time typically being less than 30 minutes. Survival diminishes with increasing burial depth, but average depth is only a foot or two under the snow. Nevertheless, it is difficult to find victims, even with currently available techniques, including probing from the surface and/or using transmitters.

In view of the forgoing, it would be desirable to develop an effective avalanche rescue device.

SUMMARY OF THE INVENTION

A rescue device includes a control module to sense an avalanche, sense the direction of the surface and establish a target path to the surface. A nozzle is selected or oriented by the control module along the target path. A fluid reservoir is connected to the nozzle to force a fluid through the nozzle along the target path to the surface. This allows rescuers to identify the location of a victim and also provides an air path to the victim.

BRIEF DESCRIPTION OF THE FIGURES

The invention is more fully appreciated in connection with the following detailed description taken in conjunction with the accompanying drawings, in which.

Like reference numerals refer to corresponding parts throughout the several views of the drawings.

DETAILED DESCRIPTION OF THE INVENTION

The disclosed apparatus aids in the rescue of someone submerged in snow. The apparatus operates by sensing the direction of the surface, establishing a target path to the surface and then spraying a fluid along the target path to the surface.

Figure 1:
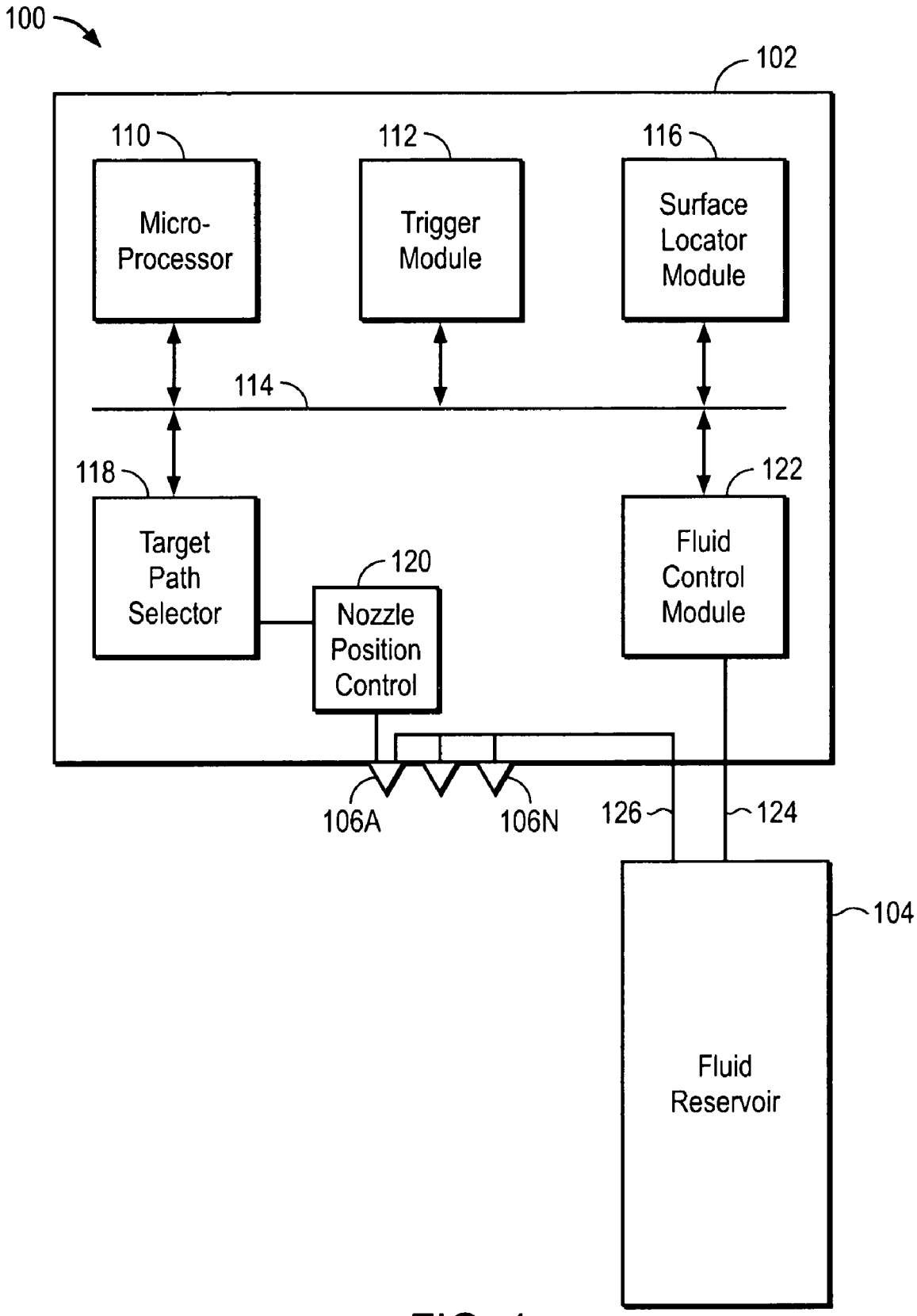
FIG. 1 illustrates an avalanche rescue device configured in accordance with an embodiment of the invention.

FIG. 1 illustrates an avalanche rescue apparatus 100 configured in accordance with an embodiment of the invention. The apparatus 100 includes two primary components: a control module 102 and a fluid reservoir 104. The control module 102 includes one or more nozzles 106A-106N.

In one embodiment, the control module 102 includes a microprocessor 110, which communicates with a trigger module 112 over bus 114. The microprocessor 110 coordinates all activities in the control module. The trigger module 112 is configured to automatically sense an avalanche condition. For example, the trigger module 112 may be implemented as an accelerometer configured to sense acceleration or turbulence events indicative of an avalanche. Preferably, the trigger module 112 includes a manual override, which allows an individual to manually indicate an avalanche condition.

A surface locator module 116 is also connected to the microprocessor 110 via bus 114. The surface locator module 116 identifies the direction of the surface after an avalanche. The surface locator module 116 may be configured to identify the direction of the surface based upon gravitational pull measured by an accelerometer.

A target path selector 118 is also connected to the microprocessor 110 via bus 114. The target path selector 118 computes an appropriate path to the surface and selects a nozzle oriented toward the appropriate path. A single nozzle 106A may be positioned via a nozzle position control 120 device, which provides mechanical manipulation of the nozzle to the appropriate position. Alternately, or in addition, one of several nozzles (e.g., 106N) may be selected by the target path selector 118.

A fluid control module 122 is also controlled by the microprocessor 110 via bus 114. The fluid control module 122 provides a control signal over line 124 to the fluid reservoir. This control signal initiates the release of a fluid through fluid line 126, which is linked to the nozzles 106A-106N.

There are many variations of the apparatus 100 that are consistent with the invention. For example, the operations of the trigger module 112 and surface locator module 116 may be combined. Similarly, the target path selector and fluid control module operations may be combined. The modules may be implemented in Field Programmable Logic Devices, Application Specific Integrated Circuits and the like. The control module 102 and the fluid reservoir 104 may be combined in a single unit. It is the operations of the invention that are significant, not the particular implementation of those operations.

Figure 2:
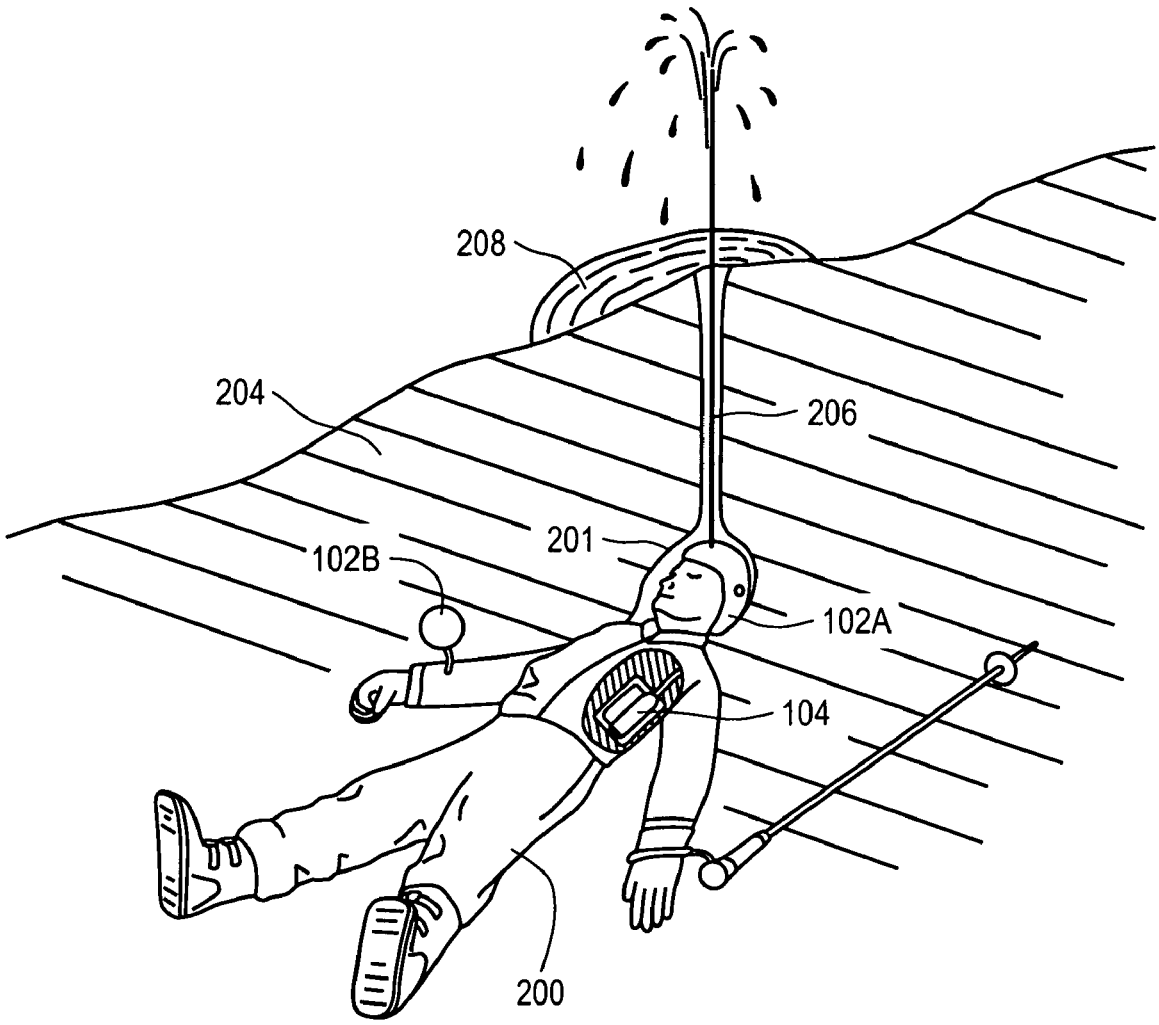
FIG. 2 is a perspective view of the operation of the avalanche rescue device of the invention.

FIG. 2 illustrates an individual 200 buried beneath an accumulation of snow 204. The figure also illustrates a control module 102A incorporated into a helmet 201. Alternately, the control module 102B may be in the form of a device tethered to a body part of the skier 200. In either embodiment, a fluid path 206 to the surface is formed. Preferably, the fluid path 206 results in a stain 208 on the surface. In this embodiment, the reservoir 104 is positioned on the torso of the skier 200.

Figure 3:
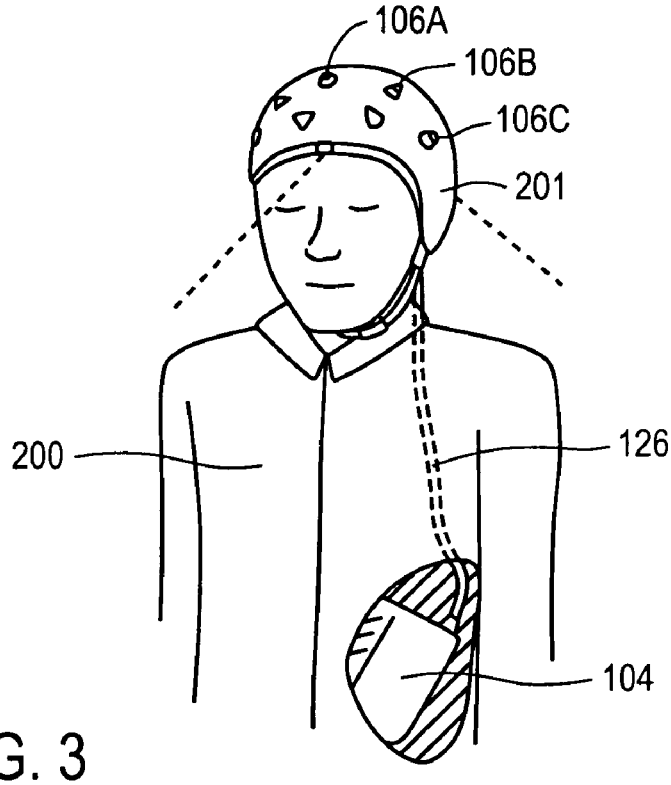
FIG. 3 is a front, cut-away view of avalanche rescue device components utilized in accordance with an embodiment of the invention.
Figure 4:
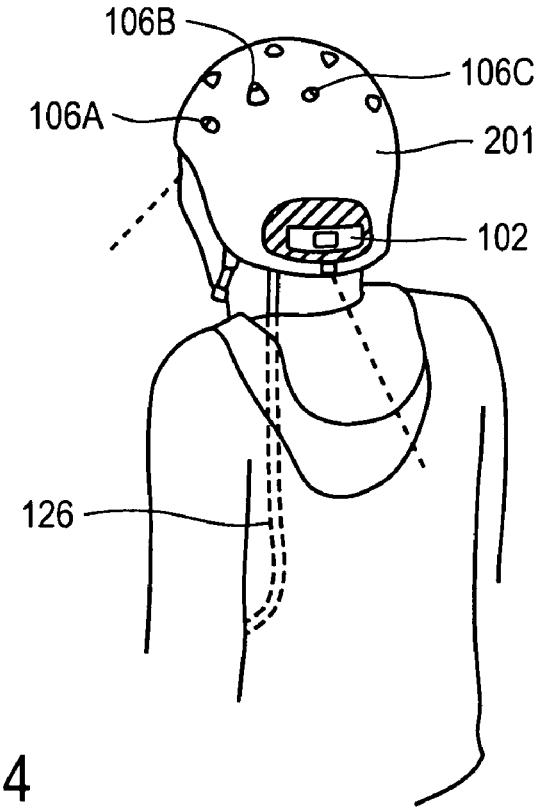
FIG. 4 is a rear, cut-away view of avalanche rescue device components utilized in accordance with an embodiment of the invention.

FIG. 3 is a front view of skier 200 with the reservoir 104 positioned on his torso. The fluid line 126 links the reservoir to one or more nozzles 106 positioned in helmet 201. FIG. 4 is a rear view of the skier 200. FIG. 4 includes a cut-away view of the control module 102 positioned within the helmet 201. The figure also illustrates nozzles 106 and fluid line 126.

Figure 5:
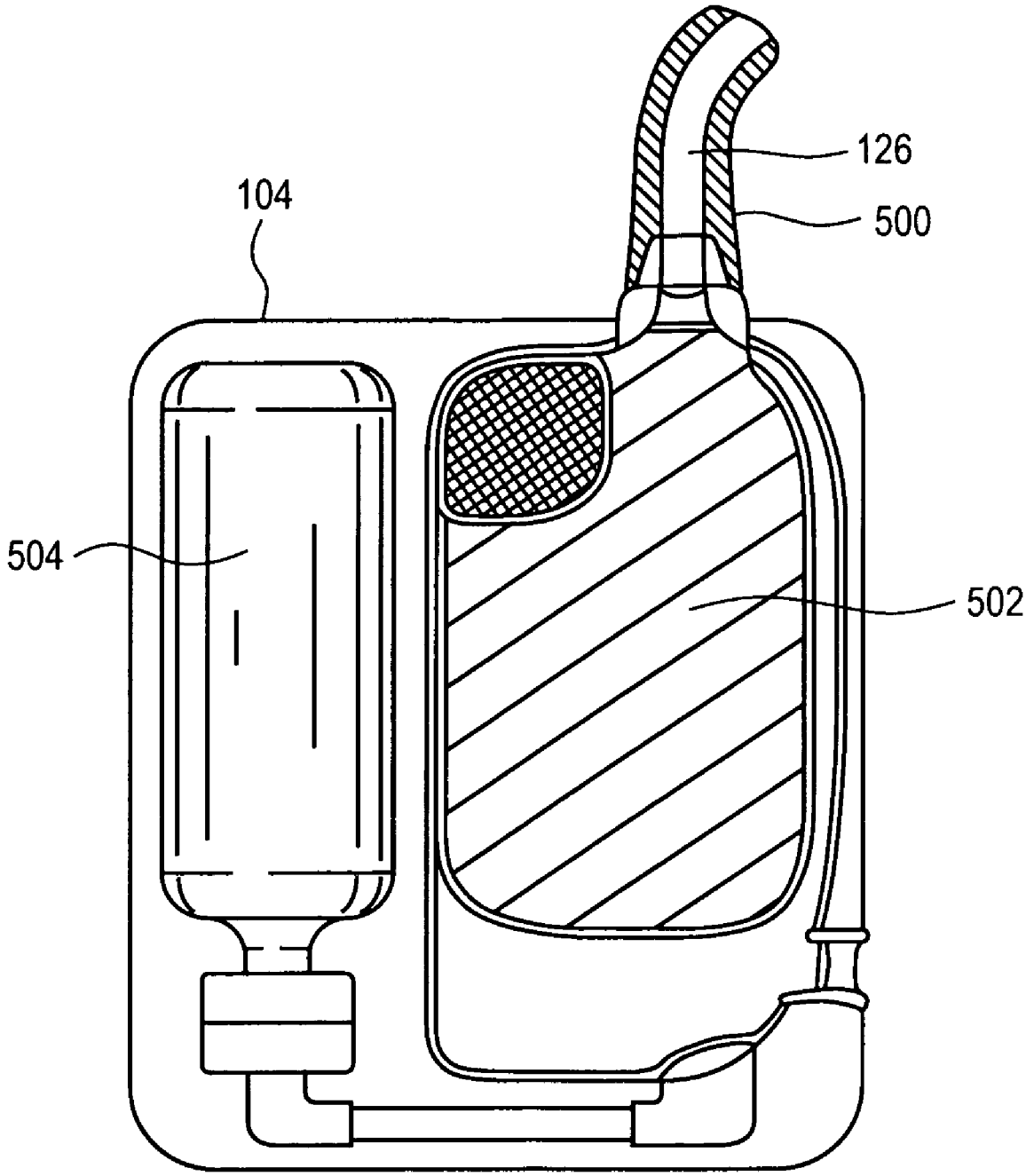
FIG. 5 illustrates a fluid reservoir utilized in accordance with an embodiment of the invention.

FIG. 5 illustrates an embodiment of the fluid reservoir 104. In this embodiment, the fluid reservoir 104 includes a fluid receptacle 502 and a pressurization source 504. The control signal from the fluid control module 122 activates the pressurization source 504 causing the eviction of the fluid in fluid receptacle 502 through fluid line 126, which is surrounded by a sleeve 500.

Now that the basic components of the invention have been explained, attention turns to a discussion of various embodiments of the invention. In one form of the invention, a hot aqueous chemical-enhanced liquid solution is directed towards the surface to create a hole through which fresh air, a mechanical signaling attachment, and/or a clearly visible dye can be can be transmitted.

The fluid reservoir 104 may include a single fluid receptacle 502 or a series of receptacles that contain a liquid and/or pressurized gas. When activated, the device sprays the liquid out of a nozzle by means of the expanding, pressurized gas, or it could be released from the nozzle by another method of sufficient force. For instance, the device could also be operated by a syringe pump that squeezes the liquid out of the nozzle. The nozzle could have a weighted swivel mechanism that serves to automatically keep it aimed upward or it could spray in many directions. It may also be implemented with a sensor that detects, by any means, which direction is "up" (from the victim to the surface of the snow) and motors or other features that orient the nozzle to point upward. Preferably, the nozzle has a small orifice in order to accelerate the liquid to high speeds. The high speed stream or jet of fluid serves to melt and/or pulverize the snow in its path and create a hollow opening, likely of tubular configuration, through the snow from the victim to the surface.

Once a path is created from the victim to the surface, a number of beneficial things can be accomplished. First of all, a dye could be mixed in with the liquid in order to stain the snow, making a contrasting unnatural mark on the snow surface, which would be easily noticeable to anyone above the surface of the snow and from a distance. The dye also aids rescuers in determining the direction in which to dig through the snow to locate the victim. Furthermore, an open pathway to the surface serves to allow ingress of fresh breathable air (oxygen) to the victim and prevent suffocation. The fresh air could diffuse through the hole, be pumped down into the opening by a mechanical pump, or be pulled down by the inhalation power of the buried person's lungs. As the hole is created, any run-off liquid that flows down and over the victim serves to melt snow around his arms and body sufficiently to allow him to perhaps maneuver in such a fashion as to facilitate self-extrication maneuvers or expansion of an existing air space. Therefore, enlarging the space of entrapment or digging one's way out through the hole becomes a possibility.

Other modes of communication to the surface include, but are not limited to, light emitted through the hole in the form of a laser or other bright beam, a chemical with a pungent or noticeable odor that disperses an olfactory signal, and/or a sound in the form of an alarm (siren) emitted from the device. Furthermore, a projected extensible probe, similar to a telescoping automobile antenna, might be directed through the pathway to extend into the air from the opening in the snow, signaling the location of the victim.

In one embodiment, the device is worn on the top of a helmet, because, considering all of the possible orientations of the victim, this is the location that has a clear line-of-sight to the surface for the most orientations following burial beneath snow. Alternately, the device is strapped onto the helmet or is integrated into the helmet and made as a helmet and rescue device together. The device(s) could also be worn in multiple helmet or body locations to increase the chances of making a clear path to the surface. The device may also be trailed behind the victim to ensure that no body parts fall in the line of sight of the device to the surface. The device may need to be released from the victim in order to allow it to orient itself to the surface of the snow and to allow a clear path to the surface without having to negotiate the obstacle presented by the buried person.

The liquid reservoir could be integrated with the nozzle. Another possibility is that the liquid reservoir could be worn on the body of the victim and the reservoir have a tube that is connected to the nozzle, which is located elsewhere on the body or helmet. This helps to keep the liquid warm by the heat of the body.

The pressurized gas could be air or air with an elevated concentration of oxygen that would outgas in the vicinity of the victim after the liquid has been depleted, reducing the risk of suffocation. The liquid ejected from the device could be at an elevated temperature, which would melt more snow, thus creating a wider opening. The chemical composition of the working liquid could be chosen to depress the freezing point of water. This is beneficial because when the working liquid is mixed with the snow, the snow's freezing point is lowered, enhancing melting and resulting in a wider hole. There are certain chemicals that are effective freezing point depressors that have the added benefit of having a substantial exothermic heat of solution when dissolved in water. For example, anhydrous calcium chloride and magnesium chloride have these properties. The device could contain water and calcium chloride separately until activation, when a barrier is removed between the two chemicals. As the calcium chloride dissolves in the water, the heat of solution is released in the form of thermal energy, which raises the temperature of the solution. The benefit of this is that no electronic heater is necessary to elevate the temperature of the liquid, and the solution that results is an effective freezing point depressor.

Initiation of the device could be triggered by many actions. In one embodiment, an accelerometer senses large changes in velocity or large changes in acceleration and sends a trigger signal when a certain threshold is reached. Darkness may also trigger the device. A sensor that detects a lack of oxygen or accumulation of carbon dioxide may also trigger the device. The victim himself could trigger the device, or a rescuer in the vicinity of the victim could remotely trigger the device. Any combination of these methods makes the triggering more reliable. Because the nozzle has a small area orifice, it would be beneficial to initiate the device by breaking a protective diaphragm or layer that protects the orifice from becoming clogged before it is initiated. The rupture of the diaphragm could be caused by pressure. The material to cover the nozzle could also be sensitive to the heat from the liquid and melt when the desired temperature is reached. It may also be sensitive to a chemical in the liquid that chemically melts the diaphragm.

As previously discussed, the nozzles collimate and accelerate the fluid into a high velocity jet stream that simultaneously penetrates and melts the overlying snow. In the embodiment of FIGS. 3 and 4, six nozzles are rigidly attached to the helmet 201. The nozzles are arranged on the faces of a cube, sphere, or other geometric shape and point in many directions. In general, four nozzles are orthogonal, and one nozzle is oriented in the opposite direction of any other nozzle. This configuration guarantees that one of the nozzles always points within a 45 degree angle of the shortest path between the victim and the surface of the snowpack, regardless of the victim's orientation.

The fluid reservoir may be implemented as a rubber bladder that sits inside a pressurized housing. The bladder may have an outlet port that extends out of the housing through a valve. A rubber pouch/balloon containing a chemical, such as calcium chloride ($CaCl_2$), sits inside the fluid reservoir. After the device is triggered, a heated wire ruptures the balloon, causing the chemical to disperse into and dissolve within the fluid. The fluid is water (with or without a chemical to lower the freezing point) that is dyed with concentrated food coloring or clothing dye or other high-visibility dye. When the $CaCl_2$ dissolves in water, the chemical reaction generates heat, causing the temperature of the solution to increase. The $CaCl_2$ also depresses the freezing temperature of water, which facilitates snow melting.

In one embodiment, the control unit 102 is implemented with programmable firmware that has analog and digital inputs and outputs. An embedded algorithm interprets data from an accelerometer. The control unit contains a current-sourcing module for actuating the valves, and hot wire for bursting the chemical balloon. Batteries are used to provide power for both the electronic control unit and the current-sourcing module.

The pressurization cylinder 504 does not need to be pressurized with compressed gas. It could be pressurized by a volatile liquid with high vapor pressure at room temperature or body temperature. Two examples are propane and butane. The cylinder could also contain oxygen as the pressurized gas. This could be released to the victim to provide him extra oxygen after the device deployed. There are several other ways to pressurize the fluid. One way is to pre-pressurize the entire housing, then open a valve to release the fluid when the device is triggered. There might also be a sealed unit inside the housing that is pre-pressurized with a valve that opens to release the fluid from the sealed unit. An example of this would be a pressurized cylinder sealed to the back of a piston/cylinder or syringe. The fluid would sit at the front of the syringe and would travel to the nozzle through a valve at the front of the syringe. One could use a mechanical/electrical pump to pressurize the fluid in the housing.

Certain chemical reactions release gas that could be used to pressurize the fluid. These chemicals could be included in the balloon inside the fluid reservoir, or could be contained in a separate unit that pressurizes the fluid in any of the ways previously described.

The pressurization system could be a single chamber that automatically orients, such as a sphere that sits inside another sphere with a fluid separating the two spheres. The outlet for the liquid would be on the bottom so that the fluid would be forced out prior to release of the lower-density pressurized gas. The chamber could be pre-pressurized with a valve at the outlet, or it could be charged after the device is triggered, using any of the previously described techniques.

The solution could be a variety of fluids, such as a snow melting agent, water, salt, $MgCL_2$, $CaCl_2$, KCL, Mg, and $CH_3COON$. Anhydrous calcium chloride and magnesium chloride have large heats of solution. A dye could be added to the solution or it could be pre-mixed into the solution. The dye could be solid or liquid. It could be a custom mixture of chemicals designed to melt snow.

The solution may be heated by chemical reaction. The reaction could be between a chemical and the fluid itself; for example, many chemicals, such as $CaCl_2$ or iron powder, release heat when dissolved in water. Heat could also be generated by a chemical reaction between chemicals somewhere outside the fluid reservoir, with the heat transferring into the fluid to increase its temperature. The fluid temperature could also be increased by heating up a wire via Joule heating (passing electrical current through a resistive wire). Any of the heating methods could occur in the housing, in the hoses or near the nozzles. A different simple way to warm the fluid is to keep the fluid reservoir near the body, where the victim's body heat would keep it warm.

The nozzle can have a variety of geometries to optimize the shape, collimation, velocity, and total fluid volume required for the jet to open a hole through the snow to the surface of the snowpack. There could be many nozzles, or there could be a single nozzle with a mechanism for orienting it properly, or there could be an orientation mechanism that is designed for a few nozzles. The victim could also manually position the nozzles before, during or after the avalanche.

There could be multiple accelerometer sensors for redundancy, or the orientation sensors could be simple mechanical gravity sensors, such as a mercury switch. The microprocessor 110 interprets the sensor data to determine which nozzles, valves or other mechanisms need to be actuated, and in what sequence they need to be actuated. The nozzles and/or nozzle unit can be stabilized using mechanical anchors or a platform after the device is triggered to ensure that the jet stays at the desired orientation.

The device may be triggered by the victim. The trigger could be a rip cord, a button or a voice-activated sensor. The device may also be triggered by one or a combination of accelerometers, light, motion, carbon dioxide, sound, impact, temperature, pressure and/or other sensors. For example, one would expect that an avalanche victim would experience large arbitrary accelerations, that it would be dark where he is buried, that he would not be moving, that there would be an accumulation of carbon dioxide near his head, and that there would be a loud rumble before he is buried followed by relative silence. One or more of these parameters may be used to conclude that an avalanche has occurred. The device may also be remotely activated by a rescuer using a wireless electronic transmitter.

The device deployment can be delayed to allow the snowpack and blowing snow to settle. There can also be a warning indicator such as a series of sounds or lights, so that the user can prevent deployment in the event of a "false positive" situation.

There are a variety of valves that could be used. For example, a heated wire, pressure or chemical reaction could break a diaphragm or melt wax that plugs the nozzle. This would help prevent the nozzle from clogging before it is utilized in an avalanche situation.

The high-speed stream or jet of fluid serves to melt and/or pulverize the snow in its path and create a hollow opening, likely of tubular configuration, through the snow from the victim to the surface of the snowpack. This hollow tubular opening creates a pathway to the surface, through which air may ingress (e.g., air diffused through the hole, air pumped or pulled down mechanically into the hole, air pulled down by the victim's inhalation, etc.). Run-off liquid from the creation of the hole could melt snow around victim's body to allow facilitation of self-extrication or expansion of an existing air space for breathing and chest wall expansion.

The design could be a multi-part design. For example, the electronics, batteries, fluid reservoir(s) and nozzle(s) could be worn at different locations by the user. It could also be a single system integrating all the components into one package. Either design could be worn as part of a jacket, vest, belt, helmet, shoe or other garment. The nozzles or some other part of the device could be tethered to the victim so that it deploys at a distance from the victim, to make sure it is not buried underneath the victim (minimize likelihood that the person obstructs the jet). A victim could also wear a number of devices for redundancy, or could have extra fluid reservoirs. A battery-life indicator could be incorporated for testing prior to wearing the device.

The hoses connecting the fluid reservoir(s) and nozzle(s) could be insulated to prevent heat loss from the fluid when the device is deployed. This would reduce the possibility of the fluid freezing if it was worn away from the body. The device could be made of high density plastic or other lightweight material, and could be designed to leak before it breaks so it is "pressure-safe" (i.e., will not explode). It can be small/compact so it can be easily incorporated into standard avalanche gear/clothing. It can be shaped ergonomically so it is comfortable to wear.

To aid locating the victim, the device could raise a flag, it could project light or a laser through the hole that can be easily detected by rescuers, the fluid could have a distinct scent or odor (detectable by people or dogs), it could sound an alarm, it could have a telescoping probe that travels up through the hole to channel sound to the surface so it is not muffled by snow). The device could also incorporate a transceiver, or launch a flare or other physical marker through the hole.

To increase the victim's survival time before a rescue, the pressurized gas can contain oxygen that would leak into the area near the victim's head, reducing the risk of asphyxiation. The fluid or other part of the device could react with the snow to produce oxygen for the victim. The fluid or other part of the device could react with carbon dioxide to reduce the carbon dioxide concentration near the victim's head. The device could incorporate a pump that would pull fresh air from the snowpack surface down the hole.

To enlarge the hole, the device can incorporate a very hot liquid. The liquid could chemically react with the snow. The device could employ a stent to maintain the mechanical stability of the hole, or an inflatable balloon that would widen the hole. It could incorporate a small explosive launched into or out of the hole that would react with water/snow to expand the hole. The device could deploy a heated structure/mechanism through the hole that would melt the snow on the walls to widen the hole.

The device may incorporate lasers, ultrasound, or electronic sensors to detect ice blocks or other obstructions in the path of the jet. The electronic control unit may use this information to select a better nozzle orientation. The device may use a laser to detect when the jet reaches the surface, and give the user a visual and/or auditory signal (such as a sequence of beeps or an electronic voice telling the victim that the device has reached the surface) to calm him down.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

The invention claimed is:

1. A rescue device, comprising:

a control module to sense the direction of a surface formed by an avalanche and establish a target path to the surface, wherein the control module utilizes the target path to designate a selected nozzle from a plurality of nozzles; and a fluid reservoir connected to the selected nozzle to force a fluid through the selected nozzle along the target path to the surface.

2. The rescue device of claim 1 wherein the control module includes a microprocessor, a trigger module, a surface locator module, a target path selector and a fluid control module.

3. The rescue device of claim 1 wherein the control module includes an accelerometer to sense the avalanche.

4. The rescue device of claim 1 wherein the control module includes an accelerometer to sense the direction of the surface.

5. The rescue device of claim 1 wherein the position of the selected nozzle is mechanically controlled by the control module.

6. The rescue device of claim 1 wherein the fluid reservoir includes a solution selected from a snow melting agent, water, salt, $MgCL_2$, $CaCl_2$, KCL, Mg, and $CH_3COON$.

7. The rescue device of claim 6 wherein the snow melting agent is dispersed prior to activation and upon mixing the heat of solution raises the temperature of the fluid.

8. The rescue device of claim 6 wherein the solution includes a colored dye.

9. The rescue device of claim 1 wherein the fluid reservoir includes a fluid chamber and a pressurization chamber.

10. The rescue device of claim 9 wherein the pressurization chamber initiates a chemical reaction.

11. The rescue device of claim 1 wherein the fluid reservoir is heated.

12. The rescue device of claim 1 wherein the control modules senses the avalanche by at least one of: acceleration, absence of light, absence of motion, $CO_2$ level and sound.

13. The rescue device of claim 1 wherein the control module is manually activated to sense the avalanche.

14. The rescue device of claim 1 wherein the control module is remotely activated.

15. The rescue device of claim 1 wherein the control module is integrated into one of a helmet, jacket or vest.

16. The rescue device of claim 1 wherein the control module provides sensory feedback to a victim.

17. The rescue device of claim 1 wherein the control module further includes at least one of: a stent, inflatable balloon, explosive, and flare.

* * * * *